United States Patent [19]

van den Berg et al.

[11] Patent Number: 4,752,715

[45] Date of Patent: Jun. 21, 1988

[54] TELEVISION CAMERA TUBE

[75] Inventors: Jacob van den Berg; Erich E. Himmelbauer, both of Eindhoven, Netherlands

[73] Assignee: U.S. Philips Corp., New York, N.Y.

[21] Appl. No.: 452,572

[22] Filed: Dec. 23, 1982

[30] Foreign Application Priority Data

Jan. 25, 1982 [NL] Netherlands ..... 8200253

[51] Int. Cl.[4] ..... H01J 31/00

[52] U.S. Cl. ..... 313/389; 313/348

[58] Field of Search ..... 313/389, 348

[56] References Cited

U.S. PATENT DOCUMENTS 3,928,784 12/1975 Weijland ..... 313/389
4,376,907 3/1983 Himmelbauer ..... 313/389
4,467,243 8/1984 Fukushima et al. ..... 313/452

*Primary Examiner*—David K. Moore
*Attorney, Agent, or Firm*—Thomas A. Briody; Jack E. Haken

[57] ABSTRACT

A television camera tube comprising an evacuated envelope enclosing an electron gun. The electron gun has, in the direction of propagation of the generated electron beam, a cathode, a grid, an anode and a cylindrical electrode. The cylindrical electrode has a diaphragm. The anode has a portion that extends substantially perpendicularly to the electron beam and includes an aperture. A first metal foil is provided on the side of the anode toward the target. The metal foil covers the aperture of the anode, but has an aperture for the electron beam. The diameter of the aperture in the foil is no more than 0.15 mm and no less than the diameter of the electron beam. A second metal foil is provided on the anode on the other side thereof. The second foil also covers the aperture of the anode. The second foil has an aperture for the electron beam. The diameter of the aperture in the second foil is smaller than the diameter of the aperture in the first metal foil, but is not less than the diameter of the electron beam. As a result, interference in the recorded image as a result of a return beam in the tube is considerably reduced.

2 Claims, 2 Drawing Sheets

TELEVISION CAMERA TUBE

BACKGROUND OF THE INVENTION

The invention relates to a television camera tube. The tube comprises, in an evacuated envelope, an electron gun. The electron gun generates an electron beam which, during operation of the tube, is focused to form a spot on a photosensitive target.

The electron beam is moved to scan the target. The electron gun, viewed in the direction of propagation of the electron beam, comprises successively a cathode, a grid, an anode and a cylindrical electrode having a diaphragm. Between the cathode and the anode, a crossover is formed in the electron beam. A part of the anode extends substantially perpendicularly to the electron beam, and has an aperture covered with a first metal foil -0-. on the side facing the target. The foil has an aperture at the area of the electron beam. The aperture in the foil has a diameter not more than 0.15 mm and not less than the diameter of the electron beam at that area.

Such a television camera tube is known from U.S. Pat. No. 3,928,784 which is incorporated herein by reference. A potential distribution is formed on the target by projecting an optical image on it. By scanning the target with the electron beam, the target provides signals corresponding to the optical image.

The photosensitive target usually consists of a photoconductive layer on a signal plate. The photoconductive layer may be considered to be composed of a large number of picture elements. Each picture element may in turn be considered as a capacitor to which a current source is connected in parallel whose current is substantially proportional to the light intensity on the picture element. The charge on each capacitor thus decreases linearly with time when the light intensity is constant.

As a result of the scanning, the electron beam passes through each picture element periodically and again charges the capacitor. This means that each picture element is periodically brought to the potential of the cathode. The quantity of charge which is necessary periodically to charge each capacitor is proportional to the light intensity on the picture element in question. The associated charging current flows to the signal plate via a signal resistor, all picture elements having the signal plate in common. As a result, a varying voltage is produced across the signal resistor, which voltage as a function of time represents the light intensity of the optical image as a function of the position of each picture element.

A television camera tube having the described operation is called a vidicon. As already described, each picture element is periodically brought to the cathode potential (zero volts). As soon as this potential is reached in a picture element the electrons of the electron beam can no longer reach the picture element. The electrons' velocities are reduced to zero, after which they are accelerated in the reverse direction.

A number of these reflected electrons form the so-called return beam which is deflected like the primary (scanning) electron beam. It has been found that at certain instants, the return beam can pass through the apertures in all the electrodes of the electron gun and can reach the space between the cathode and the anode. Many electrons have just insufficient energy to reach the cathode (which has a potential of zero volts), and they are then accelerated once again in the reverse direction. These electrons together constitute a secondary electron beam. Together with the primary electron beam, the secondary electron beam scans the photoconductive layer, but offset from the primary electron beam. The offset depends, inter alia, on the distance between the primary beam and the secondary beam in the aperture in the anode. As a result, the interfering signal is produced which is visible in the picture to be displayed.

In order to reduce the detrimental effect of the return beam, the anode in U.S. Pat. No. 3,928,784 is provided with a metal foil. At the area of the electron beam, the metal foil has an aperture with a diameter which is not more than 0.150 mm and not less than the diameter of the electron beam at that area. The diameter of the electron beam is the diameter of the smallest beam cross-section at that area. By choosing the aperture in the anode to be as small as possible, an important part of the return beam is intercepted by the anode without intercepting the primary electron beam. However, the anode does not intercept the primary electron beam. In practice it has been found that the measure described in U.S. Pat. No. 3,928,784 does reduce the interference resulting from the return beam, but does this to an insufficient extent.

SUMMARY OF THE INVENTION

It is an object of the invention to provide a television camera tube which better suppresses interference resulting from the return beam.

According to the invention, a television camera tube has a second metal foil on the side of the anode facing the cathode and covering the aperture in the anode. The second metal foil has an aperture at the area of the electron beam. The aperture in the second metal foil has a diameter smaller than the diameter of the aperture in the first metal foil, but not less than the electron beam diameter at that area (the beam diameter being the diameter of the smallest beam cross-section at that area). Since the second metal foil is situated closer to the electron beam crossover than the first metal foil, the aperture in the second metal foil may be smaller than the aperture in the first metal foil. As a result, an even larger part of the return beam is intercepted by the anode.

A large part of the return beam, however, impinges on the anode in a more or less focused manner and generates secondary electrons as a result of secondary emission. If the first metal foil were not to be omitted, secondary electrons having a given intensity and direction would be generated on the side of the anode facing the target. Secondary electrons having a different intensity and direction would be generated in the deeper-situated second metal foil, which is further from the target. Since some of the generated secondary electrons have substantially the same kinetic energy as the electrons of the return beam, these will form a secondary beam which, together with the original (primary) electron beam, scans the photoconductive layer offset from the primary electron beam, because the secondary electron beam is formed by electrons which have traversed the deflection fields three times instead of once. Owing to the differences in secondary emission of different parts of the anode that would occur if the first foil were omitted, an interfering signal would be formed which would be visible in the picture to be displayed. By continuing the use of the first metal foil the secondary electrons are generated only in a substantially flat surface, as a result of which interference in practice is much less than if the first metal foil were to be omitted.

DESCRIPTION OF THE PREFERRED EMBODIMENTS

Figure 1:
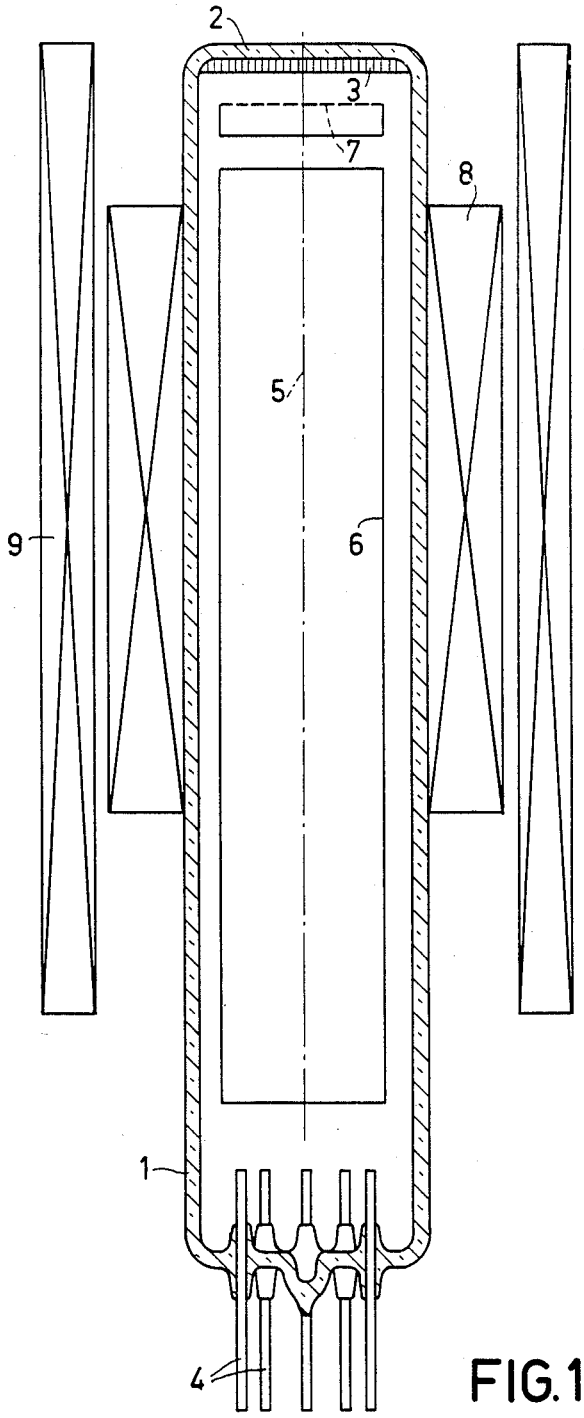
FIG. 1 is a longitudinal sectional view of a television camera tube according to the invention.

The television camera tube according to the invention, as shown in FIG. 1, comprises a glass envelope 1 having at one end of a window 2. On, the inside of window 2, a photosensitive target 3 is provided. Target 3 consists of a photoconductive layer and a transparent conductive signal plate between the photosensitive layer and the window. The photoconductive layer consists mainly of specially activated lead monoxide and the signal plate consists of conductive tin oxide.

The connection pins 4 of the tube are at the opposite end of the glass envelope 1. The tube comprises, centered along an axis 5, an electron gun 6. In addition the tube comprises a gauze-like electrode 7 to produce perpendicular landing of the electron beam on the target 3. Deflection coils 8 serve to deflect the electron beam generated by the electron gun 6 in two mutually perpendicular directions and to scan a frame on the target 3. A focusing coil 9 focuses the electron beam on the target 3. The electron gun will be described in greater detail with reference to FIG. 3.

Figure 2:
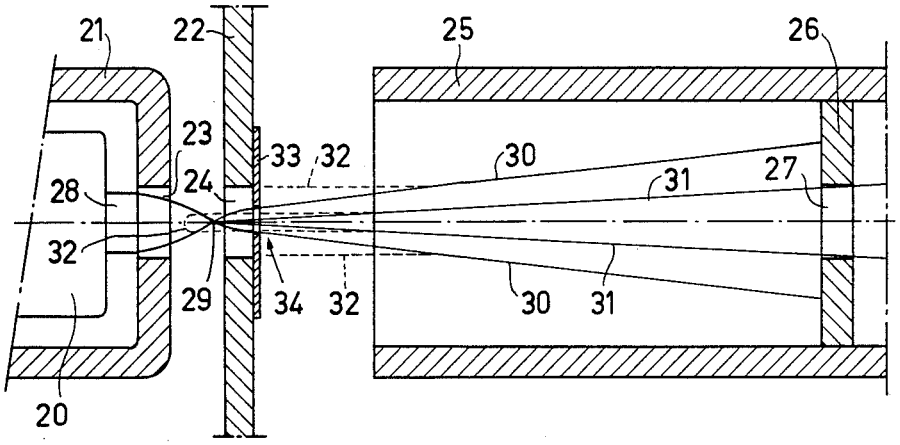
FIG. 2 (PRIOR ART)
FIg. 2 is a longitudinal sectional view of a prior art electron gun for a television camera tube.

FIG. 2 is a longitudinal sectional view of a prior art electron gun (U.S. Pat. No. 3,928,784). This electron gun comprises a cathode 20, a grid 21 and an anode 22. The grid 21 has an aperture 23 having a diameter of 0.6 mm. The anode 22 has an aperture 24 having a diameter of 0.6 mm. The electron gun further comprises a cylindrical electrode 25 having a diaphragm 26 with aperture 27 of a diameter of 0.6 mm.

The electron beam 28, starting from the cathode 20, forms a beam crossover 29 under the influence of the voltages on the cathode 20, the grid 21, the anode 22 and the electrode 25. The beam crossover 29 is focused on the target of the television camera tube by means of a focusing lens, for example a focusing coil (see FIG. 1, focusing coil 9).

Since the diameter of the beam crossover 29 which is shown substantially as a point, is in fact much larger than is desired, the cross-section of the electron beam 30 must be limited. The aperture 27 in the diaphragm 26 through which only the electron beam 31 can pass serves this purpose.

In order to intercept as much as possible of the return beam 32, the anode 22 has a foil 33 with an aperture 34. The diameter of the aperture 34 is 0.1 mm and has been chosen to be such that as much as possible of the return beam 32 is intercepted but the whole primary beam 28 is passed. Nevertheless, return beam 32 proves to pass through the aperture 34 in practice. It is not possible to make the aperture 34 smaller since in that case the primary electron beam 28 will be partly intercepted.

Figure 3:
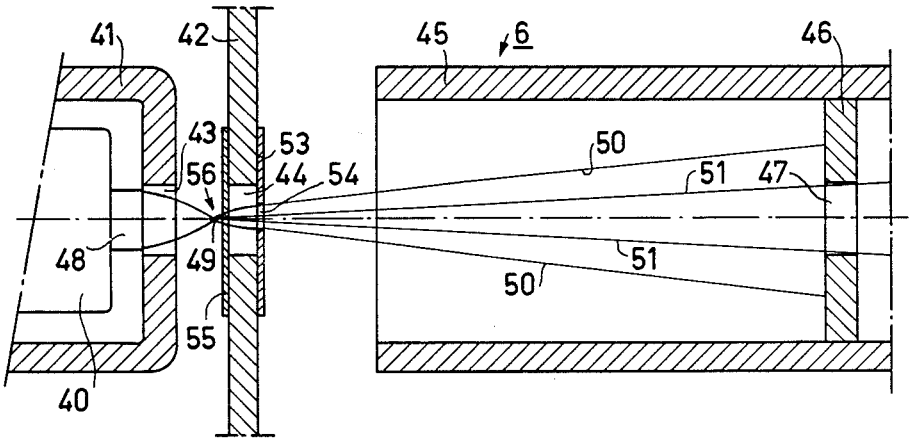
FIG. 3 is a longitudinal sectional view of an electron gun for a television camera tube according to the invention.

FIG. 3 is a longitudinal sectional view of an electron gun 6. This electron gun comprises a cathode 40, a grid 41 and an anode 42. The grid 41 has an aperture 43 having a diameter of 0.6 mm. The anode 42 has an aperture 44 having a diameter of 0.6 mm. The electron gun further comprises a cylindrical electrode 45 having a diaphragm 46 with an aperture 47 having a diameter of 0.6 mm.

The electron beam 48 starting from the cathode 40 forms a beam crossover 49 under the influence of the voltages on the cathode 40, the grid 41, the anode 42 and the electrode 45. The beam crossover 49 is focused on the target of the television camera tube by the focusing lens, for example a focusing coil (see FIG. 1, focusing coil 9).

Since the diameter of the beam crossover 49 which is shown substantially as a point, is much larger than is desired, the cross-section of the electron beam 50 must be limited. Aperture 47 in the diaphragm 46 which passes only the electron beam 51 serves this purpose.

The anode 42 has a foil 53 having an aperture 54 and has a foil 55 having an aperture 56. The diameter of the aperture 54 is 0.12 mm and the diameter of the aperture 56 is 0.08 mm. Because the area of the aperture 56 is much smaller than the area of the aperture 34 in FIG. 2, a larger part of the electrons of the return beam is intercepted than in the FIG. 2 gun.

Omitting foil 53 is not desirable because in that case the anode, viewed from the target, is no longer flat. Upon scanning the anode with the focused return beam, a step is formed in the secondary emission at the area where the aperture 44 begins. This results in interference in the image.

The spacing between the cathode 40 and grid 41 is 0.1 mm. The thickness of the foils 53 and 55 is 0.05 mm. The thickness of the grid 41 is 0.2 mm. The spacing between grid 41 and anode 42 is 0.25 mm. The thickness of the anode 42 is 0.2 mm. The inside diameter of the electrode 45 is 10 mm. The spacing between the apertures 54 and 47 is 12 mm.

During the scanning of the photoconductive layer by the electron beam the voltages on the electrodes are as follows:

cathode 40: OV
grid 41: −40 V
anode 42: 300 V
electrode 45: 300 V.

What is claimed is:

1. A television camera tube comprising:

an evacuated envelope having an axis;

a photosensitive target in the envelope at an end thereof; and an electron gun arranged in the envelope on the axis for generating an electron beam which is scanned across the target, said electron beam having a crossover, said electron gun comprising:

a cathode;

a grid spaced from the cathode along the axis toward the target;

an anode spaced from the grid along the axis toward the target, at least a portion of the anode being substantially perpendicular to the axis, said anode having a first side oriented toward the target and having a second side oriented toward the grid, said anode having an aperture therethrough on the axis; and a cylindrical electrode spaced from the anode along the axis toward the target;

characterized in that:

the tube further comprises a first metal foil covering the first side of the anode, said foil having an aperture therein on the axis, the aperture having a diameter less than or equal to 0.15 mm but greater than the diameter of the electron beam at the area of the first metal foil;

the tube further comprises a second metal foil covering the second side of the anode, said second metal foil having an aperture therein on the axis, the aperture having a diameter less than the diameter of the aperture in the first metal foil but greater than the diameter of the electron beam at the area of the second metal foil; and the crossover in the electron beam is arranged between the cathode and the anode.

2. A television camera tube as claimed in claim 1, further comprising means for applying voltages to the cathode, grid, anode and cylindrical electrode to form a crossover in the electron beam between the cathode and the anode.

* * * * *